US007481650B2

(12) United States Patent
Mosiewicz et al.

(10) Patent No.: US 7,481,650 B2
(45) Date of Patent: Jan. 27, 2009

(54) DIRECT GAS-FIRED BURNER ASSEMBLY WITH TWO-STAGE COMBUSTION

(75) Inventors: Pawel Mosiewicz, Chicago, IL (US); Ceji Li, Bloomingdale, IL (US)

(73) Assignee: Midco International, Inc., Chicago, IL (US)

( * ) Notice: Subject to any disclaimer, the term of this patent is extended or adjusted under 35 U.S.C. 154(b) by 1324 days.

(21) Appl. No.: 10/306,199

(22) Filed: Nov. 27, 2002

(65) Prior Publication Data

US 2004/0101797 A1 May 27, 2004

(51) Int. Cl.
*F23D 14/00* (2006.01)

(52) U.S. Cl. ..... 431/351; 431/8; 431/10; 431/350; 126/110 B; 126/110 C; 126/110 D; 432/222; 237/50

(58) Field of Classification Search ..... 431/8, 431/10, 350, 351, 352, 353; 239/397.5, 430, 239/553.5; 432/222; 126/110 B, 110 C, 126/110 D; 237/50, 52
See application file for complete search history.

(56) References Cited

U.S. PATENT DOCUMENTS 3,051,464 A * 8/1962 Yeo et al. ..... 432/222
3,186,697 A * 6/1965 Haedike et al. ..... 432/47
3,265,376 A * 8/1966 Spielman ..... 432/222
3,297,259 A 1/1967 Maxon, Jr. et al.
3,494,711 A * 2/1970 Spielman ..... 431/165
3,592,578 A * 7/1971 Weatherston ..... 431/268
3,630,499 A * 12/1971 Kramer, Jr. ..... 432/222
3,830,618 A * 8/1974 Smithson et al. ..... 431/5
4,573,907 A * 3/1986 Coppin et al. ..... 431/351
4,869,665 A * 9/1989 Coppin ..... 431/351
4,993,944 A * 2/1991 Potter et al. ..... 432/222
5,083,918 A 1/1992 Potter et al.
5,131,836 A * 7/1992 Coppin ..... 431/12
6,394,795 B2 * 5/2002 Fayerman et al. ..... 432/222
6,526,964 B1 * 3/2003 Potter et al. ..... 126/110 C
6,857,870 B2 * 2/2005 Topp ..... 431/350
6,921,261 B2 * 7/2005 Perry ..... 431/351

* cited by examiner

*Primary Examiner*—Carl D Price
(74) *Attorney, Agent, or Firm*—Marshall, Gerstein & Borun LLP

(57) ABSTRACT

A direct gas-fired burner assembly is disclosed in which a two-stage flame is produced. A gas manifold is attached to two baffles with apertures disposed therein. The apertures are designed such that a fuel rich zone occurs near the manifold, while a lean zone occurs away from the manifold. At high fire, the apertures create a negative pressure zone which draws the gas away from the burner thereby allowing a primary flame to burn. The primary flame in the fuel rich zone ignites a secondary flame in the lean zone. Because a flame is burning throughout the entire combustion zone, the flame does not move out past the baffles, the flame remains smaller and cooler, and a lower output of pollutants is achieved.

17 Claims, 4 Drawing Sheets

DIRECT GAS-FIRED BURNER ASSEMBLY WITH TWO-STAGE COMBUSTION

FIELD OF THE DISCLOSURE

The disclosure is generally related to heating apparatus, and more particularly, a gas-fired burner for a direct gas-fired air heater.

BACKGROUND OF THE DISCLOSURE

In many situations, air within a building must be continuously replaced, for health or comfort reasons. Conditions such as these are frequently found in paint spray shops, foundries, chemical plants, welding shops, large restaurants, bowling alleys, etc. However, taking in a large amount of ambient air can overburden building's heating system. In these situations, a "make-up" air heater is used to temper the incoming air, raising it to room temperature and thus relieving the building heating plant of the extra load.

In such situations, a gas manifold with a gas outlet is disposed in an air duct. The outlet is typically flanked on both sides by baffles with air inlets, defining therebetween a combustion chamber. The burner is located downstream of the airflow. Air flow, generated by a fan located downstream of the baffles, flows through the air inlets in the baffles and into the combustion chamber to mix with the gas and thus feed a flame. The baffles further serve to protect the flame from an excessive supply of air, thus preventing the flame from being quenched. The flame and its byproducts are mixed directly with the air stream and added to the space being heated. A heating process such as this does not require a heat exchanger and is therefore more energy efficient. However, the products of combustion, including carbon monoxide, nitrogen dioxide, and carbon dioxide, are not separated from the air stream, and are delivered directly to the occupied space.

Depending on the magnitude of the temperature change needed to the air, the burner firing intensity must be changed. The intensity changes from a minimum fire, in which the entire flame is maintained near the gas ports, to a high fire, in which the flame fills and in some cases exceeds and burns outside of the combustion chamber.

To accommodate the need for a dynamic firing intensity, the air inlets in the baffles are sized from very small next to the manifold, and increase progressively to the exit of the combustion chamber. When the flame is at low fire, only a small amount of air is necessary and the fire is maintained near the manifold. When the flame intensity increases, the flame fills the combustion chamber and is fed by the remaining openings located in the baffles.

In prior art designs, when the firing intensity is high, the flame is only established toward the end of the baffles away from the manifold. This is because only by the larger holes in the ends of the baffles is enough air admitted into the combustion chamber to create the proper air to fuel mixture. The flame can further extend outside of the protective baffles, exposing the flame to excess ambient air and thereby producing large amounts of nitrogen dioxide. If too much air is added to the combustion chamber at a particular firing rate, the flame is quenched, thereby resulting in high carbon monoxide emission.

Proper sizing and position of air openings in the burner baffles is therefore of importance. By sizing the openings and strategically placing them relative to the gas ports, flame characteristics can be shaped and controlled. The maintenance of high fire flame characteristics is also of high importance and has not heretofore been investigated. There is a need to size and place the baffle openings such that they can be utilized for controlling the flame shape and its characteristics throughout the entire firing rate, including high fire. Such control contributes to increased Btu output, a higher turndown ratio, flame stability and emission reduction.

Carbon monoxide and nitrogen dioxide emission levels are controlled by law. Currently, ANSI standards Z83.4, Non-Recirculating Direct Gas-Fired Industrial Air Heaters, and Z83.18, Recirculating Direct Gas-Fired Industrial Air Heaters dictate the emissions limits permitted by a direct-fired heaters. Moreover, not only are emission standards mandated, but it has been found that by lowering the emissions of carbon monoxide and nitrogen dioxide, overall performance of the burner can be increased. For example, lower carbon monoxide emissions permit the burner to operate in higher airflows, thereby increasing Btu output, while lower nitrogen dioxide emissions allow the burner and the air heaters to attain higher temperature rise, and thus increasing its operation range.

Moreover, many existing plants already have a manifold installed. Prior burners required a larger manifold and combustion chamber to increase Btu output. It would be of great benefit to retrofit an already installed manifold with baffles that increase Btu output while lowering emissions, without increasing the burner's footprint.

SUMMARY OF THE DISCLOSURE

In accordance with one aspect of the disclosure, a gas-fired burner assembly is disclosed which may include a burner manifold including a pair of shoulders defining a trough therebetween, a gas conduit disposed within the manifold and linked to the trough by a plurality of gas ports that transport gas from the conduit to the trough, at least one air port provided in each shoulder, each air port linking the trough to ambient air to transport air into the trough, each air port being located substantially between each of the plurality of gas ports so as to form an air buffer between each gas port, a pair of baffles comprising a plurality of rows of apertures, fastened to the shoulders, and extending away from the trough in substantially a V-shape defining a combustion chamber therebetween, the plurality of rows divided into at least a primary group of rows, the primary group of rows comprising a first row of apertures and a second row of apertures, the first row of apertures including a plurality of aperture pairs, each pair being directly above a corresponding air port, thereby forming an air buffer between the gas ports, and the second row of apertures including a plurality of aperture triads, each triad being directly above a corresponding air port, thereby forming an air buffer between the gas ports and creating a negative pressure zone above the air ports.

In a second aspect of the disclosure, a method of combustion is disclosed which may include the steps of directing gas from a manifold into a V-shaped combustion chamber, the combustion chamber having first and second side baffles, the manifold having a plurality of spaced apertures in a trough, forcing air into the trough through a plurality of spaced air inlets provided in side walls of the trough, igniting the gas and air in the trough, and maintaining combustion from the trough to the baffle end flanges.

In a third aspect of the disclosure, a gas-fired burner assembly is disclosed which may include a gas manifold having a plurality of gas inlets, first and second baffle plates extending from the gas manifold and flanking the gas inlets at an acute angle, the first and second baffle plates having a plurality of air inlets, first and second end plates extending between the first and second baffle plates at first and second ends of the gas manifold, a primary combustion zone proximate the gas manifold, a secondary combustion zone separated from the gas manifold by the primary combustion zone, combustion in the primary combustion zone consisting of a plurality of individual flames, the plurality of individual flames extending from each of the gas inlets, combustion in the secondary zone being ignited by combustion in the primary combustion zone, combustion in the secondary combustion zone consisting of a plurality of individual flames extending from each of the plurality of baffle plate air inlets, and combustion from the primary and secondary combustion zones being contained entirely within the baffle plates and end plates.

These and other aspects and features of the disclosure will become more apparent upon reading the following detailed description when taken in conjunction with the accompanying drawings.

Figure 1:
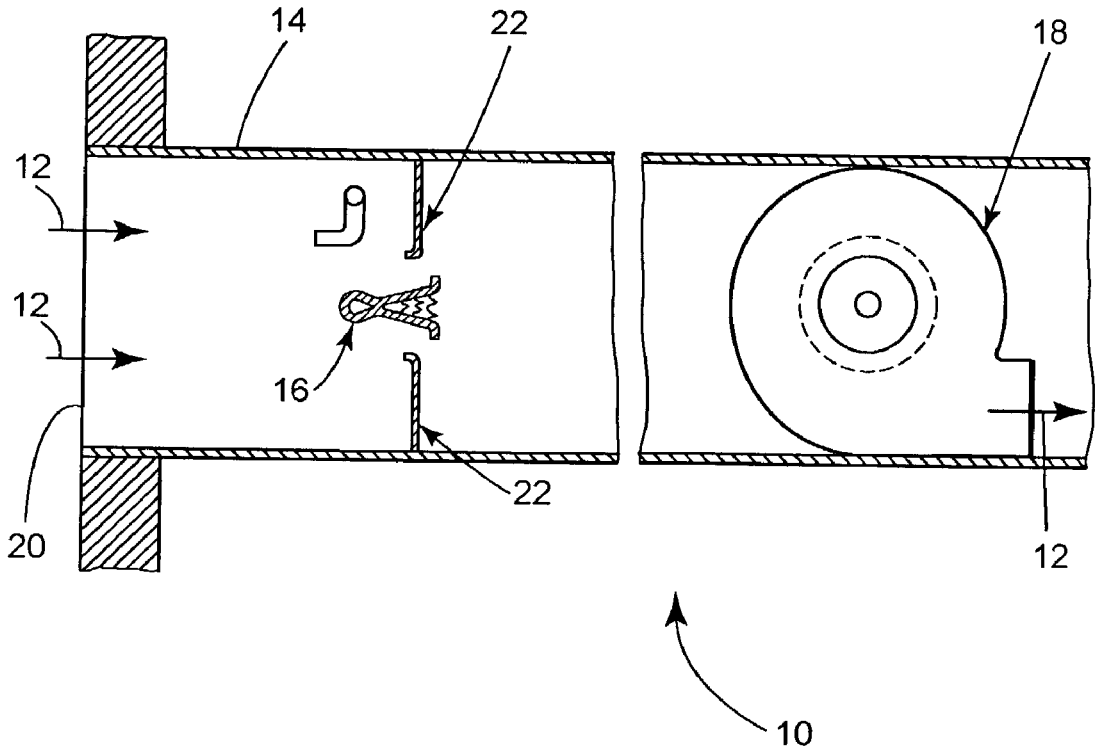
FIG. 1 is a side view, partially sectioned, of a direct gas fired burner assembly mounted in an air duct.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and the equivalents falling within the spirit and scope of the invention as defined by the appended claims.

DETAILED DESCRIPTION OF THE DISCLOSURE

Referring now to the drawings, FIG. 1 shows a gas-fired burner assembly generally depicted as reference numeral 10. The assembly 10 employs an air stream 12 conveyed through a duct 14 past a gas burner 16 under the control of a blower 18. The air stream 12 may be either a fresh air stream, for example, wherein the duct 14 is connected to a fresh air inlet 20, or the air stream may be a recirculating stream, for example, wherein the duct 14 is part of a recirculating duct arrangement of an industrial oven or the like and sufficient fresh air or oxygen to permit complete combustion is added to the recirculating stream at a point not shown. The assembly 10 can further be supplied with a plate 22 to direct the air stream 12 to the burner 16.

The gas burner 16 may include individual burner units 17 (best seen in FIG. 2), fastened together and forming a desired pattern across the area of the duct. The heating flame occurs in a substantially continuous path along the length of each burner unit 17 and the burner shown distributes the flame and heat in a desired pattern across the air stream 12. The gas burner 16 is supported by structure (not shown) within the duct 14 in transverse relationship to the moving air stream 12, whereby the air stream 12 is substantially uniformly heated by the burner 16. The burner 16 is connected to a fuel supply line (not shown), which, in turn, is connected to a valve (not shown) to control the amount of gas being supplied to the burner 16 and to effect a wide range of firing rates, i.e. low, intermediate, and high firing rates.

Figure 2:
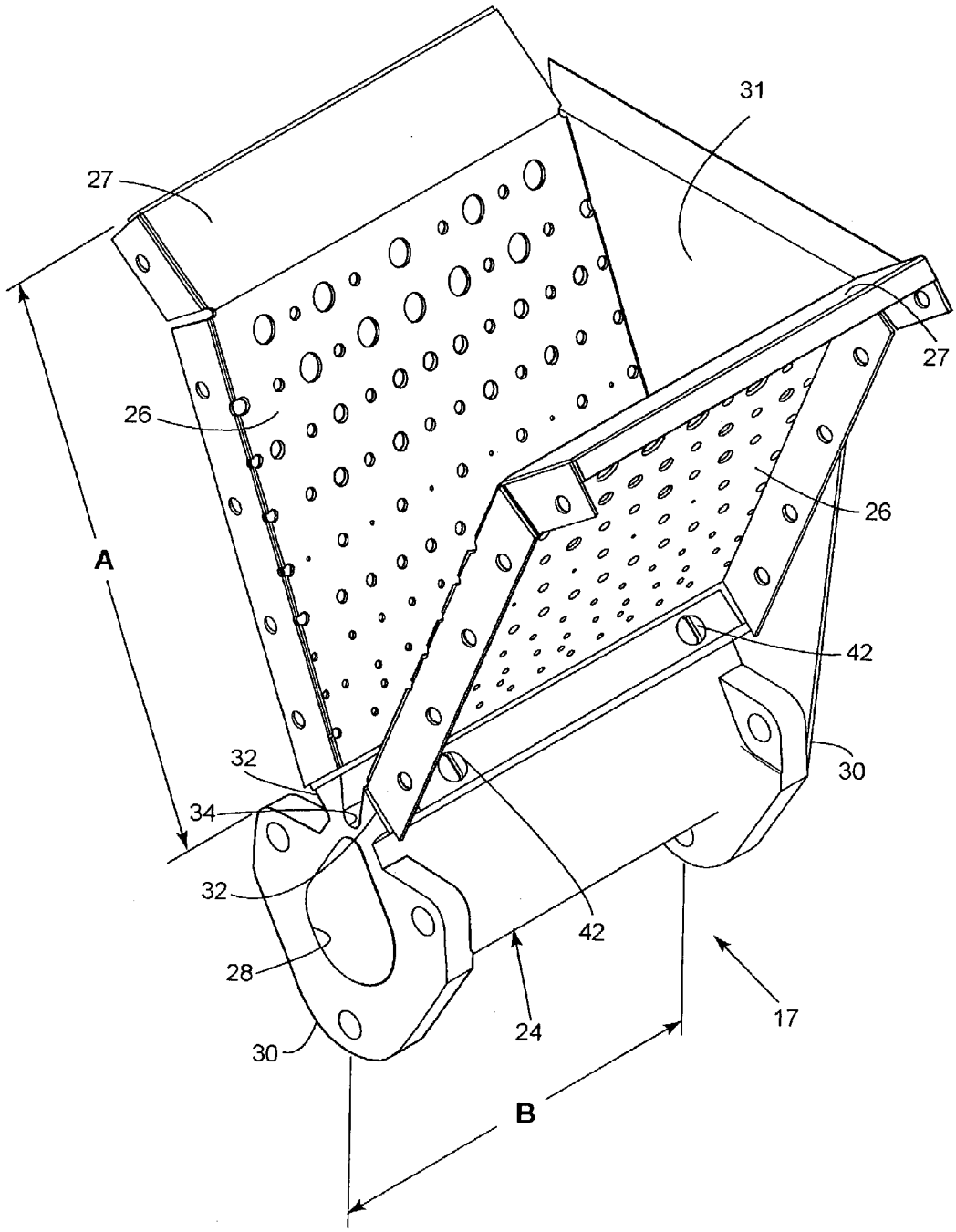
FIG. 2 is a perspective view the burner assembly of FIG. 1.

As shown in FIG. 2, each burner unit 17 is comprised of a manifold 24 and a pair of generally diverging baffles 26. The baffles 26 extend in generally a V-shape away from the manifold 24, forming an acute angle $\alpha$. The baffles 26 each include an end flange 27 which in the present embodiment is imperforate. The end flanges 27 define a second angle $\beta$, wherein the angle $\beta$ is larger than the angle $\alpha$. The burner 16 is disposed within the air stream 12 so that the manifold 24 is upstream of the baffles 26. As shown in FIG. 1, the manifold 24 faces upstream in opposition to the direction of flow of the air stream 12, and the baffles 26 open downstream in the direction of flow of the air stream 12.

The manifold 24 may include a generally tear-shaped (in cross section) fuel conduit 28 running the axial length of the manifold 24. Attachment flanges 30 are disposed on the ends of the manifold 24 for fastening burner units 17 to each other or, in the case of an end most burner unit 17 of a segmented burner 16, an end plate 31. On the downstream side of the manifold 24 are disposed a pair of shoulders 32 that run the axial length of the manifold 24. In between the shoulders 32 is defined a trough 34. The space between the baffles 26 and end plates 31 and including the trough 34 is defined as the main combustion chamber 35.

Figure 3:
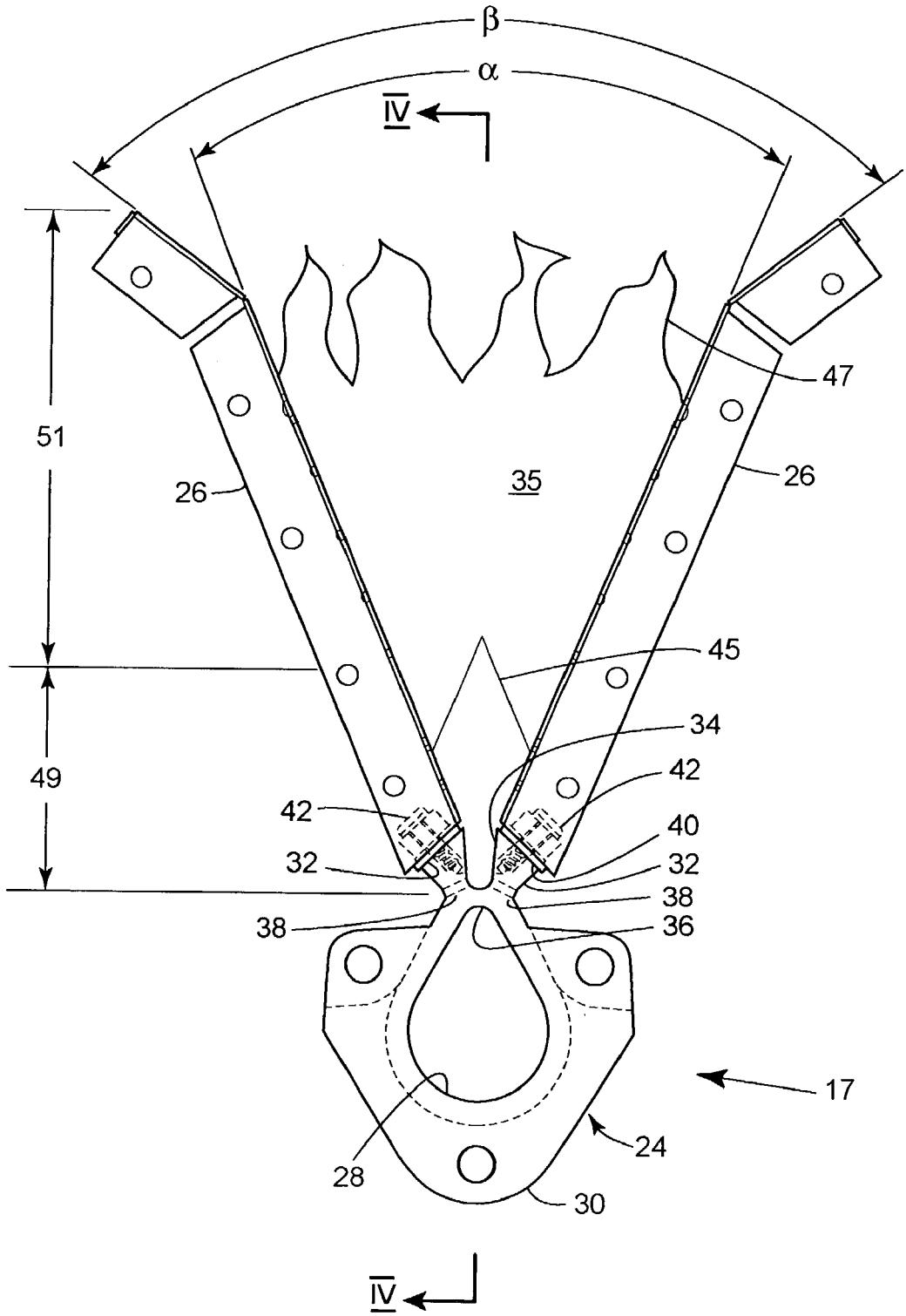
FIG. 3 is an end view of the burner assembly of FIG. 2.

As shown in FIG. 3, linking the fuel conduit 28 with the trough 34 are a series of gas ports 36. The gas ports 36 are apertures within the manifold 24 and allow gas to flow from the conduit 28 into the trough 34. The ports 36 are located axially along the trough 34 and, in one non-limiting example, the ports 36 are placed one inch apart, center to center.

Supplying the burner unit 17 with air is a series of air ports 38. The ports 38 are disposed in each of the shoulders 32. The ports 38 are also disposed longitudinally along the length of the shoulders 38 and, in a further non-limiting example, each port 38 is placed one inch apart. As can best been seen in FIG. 4, the air ports 38 are disposed generally midway between each gas port 36. By disposing the air ports 38 midway between the gas port 36, air streams provided by the air ports 38 provide an air buffer between each of the flames above each gas port 36. The primary reason for the air ports 38 is to supply air for minimum fire. Minimum fire is defined as the smallest flame that can be maintained in the combustion chamber without being quenched. At minimum fire, the entire flame is contained within the trough 34, and all air necessary to maintain minimum first is supplied by the air ports 38. Due to the air buffer provided by the air ports 38, an individual flame is created directly above each gas port 36.

As indicated above, fastened to the manifold 24 are the baffles 26. Each shoulder 32 includes an outer surface 40. In this example, the outer surfaces 40 include a plurality of threaded holes into which bolts 42 or the like may be screwed to secure the baffles 26 to the manifold 24.

Figure 4:
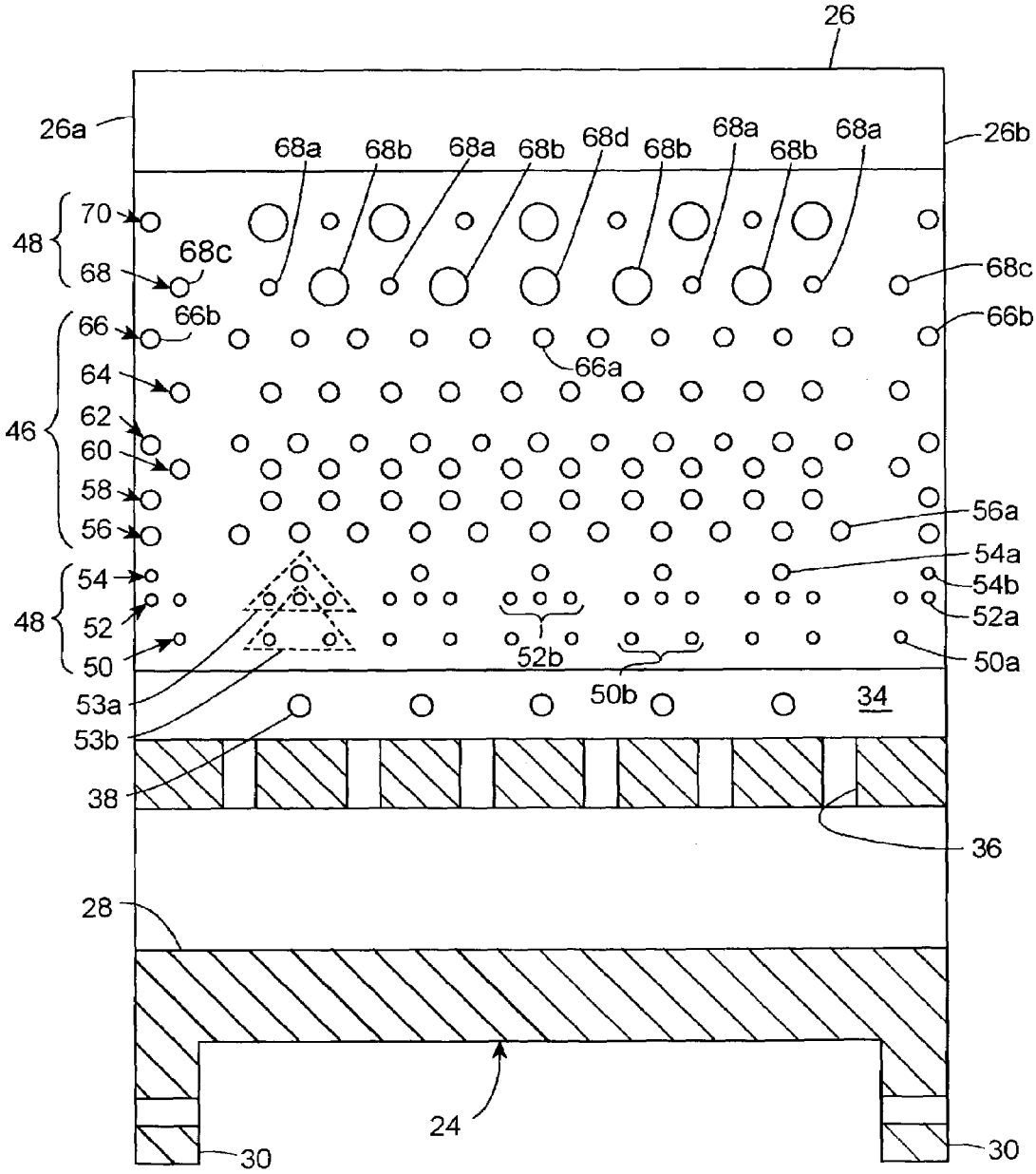
FIG. 4 is a side sectional view of the burner taken along line IV-IV of FIG. 3.

As shown in FIG. 4, each of the baffles 26 in the depicted embodiment includes eleven rows of apertures, each being substantially parallel to the manifold 24. In alternate embodiments, a greater or lesser number of rows can be provided. The rows are arranged into three groups: a primary group 44, a secondary group 46, and a tertiary group 48. The three groups 44, 46, 48 interact with a varying supply of air to the flame to create a two-stage combustion, including a primary flame 45, and a secondary flame 47, best seen in FIG. 3, and more particularly described below.

Initially, it must be recognized that the row of air ports 38 may be moved from the manifold 24 to the baffles 26 without a change in performance.

The first group 44 may include a first row 50, second row 52, and third row 54. The first group 44 contributes to the formation of the primary flame 45 within a primary flame zone 49 of the combustion zone 35.

The first row 50 may include a series of apertures **50*a*. The apertures 50*a* allow air from the air stream 12 to flow into the combustion zone 35 and feed the primary flame 45. The apertures 50***a* are disposed in pairs 50*b*, each pair 50*b* being located directly above an air port 38, and each individual aperture 50*a* of the pair 50*b* flanking each of the air ports 38. The apertures 50*a* provide a supply of air to the flame at low fire, and further also provide a buffer of air between each of the gas ports 36.

The second row 52 is located just above the first row 50. It is comprised of apertures 52*a* arranged in triads 52*b*. Apertures 52*a* also form a buffer between the gas ports 36, however, their arrangement together with the first row 50 creates a negative pressure zone between the arrangement. This zone allows for the establishment of a two stage combustion including a primary flame 45 that is maintained in the primary flame zone 49 throughout all firing intensities. The arrangement and size of the openings located in row 50, 52, and 54 help to create the two-stage combustion at high fire. In the disclosed example, the openings are placed between the gas ports 36 and are arranged in triangular patterns 53*a* and 53*b*, the first triangle 53*a* being located above the second triangle 53*b*. At minimum fire, an individual flame is created above each of the gas ports 36. As the firing intensity changes from low to high, the primary flame 45 is anchored at the manifold 24 and continues to burn in the initial location, creating the primary flame zone 49. At high fire, in prior art burners, the fuel to air ratio in the primary flame zone 49 exceeds the flammability limits. In prior art burners, at high fire the flame is established away from the manifold and extends to the outer edge and beyond the baffles. However, with the burner 10, the triangular patterns 53*a* and 53*b* of the openings in the rows 50, 52, and 54 create a negative pressure and pull a fraction of the gas away from the gas port 36 thereby making combustion in the primary flame zone 49 possible. The arrangement of the openings in the rows 52, 54 forming triangular patterns 53*a* and 53*b* is located between the gas ports 36. As the gas intensity changes from low to high to satisfy the firing intensity, the main jet core passes next to the openings of row 50, 52, and 54. The negative pressure inside of each of the triangular patterns 53*a* and 53*b* and the gradient of the mixture concentration created by the air stream pulls gas away from the main core into the triangular patterns 53*a* and 53*b*. The flame established in this zone defines the primary flame zone 49. The primary flame 45 is visible when one looks into the flame at all firing rates. It is noted that two triangles are disclosed infra, however, it is clear that other designs of apertures in a baffle which similarly cause a negative pressure could be easily designed without departing from the scope of this invention.

The third row 54 is comprised of apertures 54*a*, each aperture 54*a* being disposed directly above and in between the gas port 36 and above the second row 52. The sizes of the apertures are determined by maximizing the air introduction into the combustion zone 35, yet maintaining compliance with legal limits of carbon monoxide at low fire. At high fire, the air from the third row 54 contributes to the maintenance of the primary flame 45 creating the last opening in the triangular pattern.

The secondary group 46 may include a fourth row 56, fifth row 58, sixth row 60, seventh row 62, eighth row 64, and ninth row 66. The fourth row 56 comprises apertures 56*a* that are each disposed directly over the gas ports 36. The apertures 56*a* of the fourth row 56 provide an air stream that breaks the stream of gas emitted from the gas ports 36. The gas becomes mixed with the air, and a secondary flame 47 is ignited by the combustion of the primary flame 45 in the primary flame zone 49. The secondary flame 47 continues through the combustion zone 35 being supplied with air from fifth, sixth, seventh, eighth and ninth rows, 58, 60, 62, 64, 66. Rows five through nine comprise apertures with optimized sizes at optimized locations which are sized for maximum air flow while still maintaining the burner within the legal specifications. Individual flames extend from each aperture, instead of one large flame within the combustion chamber 35. Because a primary flame 45 is maintained during all firing rates, the secondary flame zone 51 at high fire is contained within the main combustion zone 35.

With prior art burners, during high and intermediate fire, combustion initiates and is established only in secondary combustion zone 51. Moreover, the fire may further extend outside of the combustion zone beyond the baffles 26. The reason why the flame at high fire was not established in prior art burners in the primary combustion zone 49 as in the present disclosure is due to the typical design of the rows of holes adjacent the manifold of the prior art design. Typically, the openings are sized for low fire only, i.e., the openings adjacent the manifold are maximized to allow maximum air at low fire and still comply with the CO emission regulations. By simply sizing the openings to allow maximum air for each firing stage, at high fire the gas to air ratio is too rich adjacent the manifold and no combustion can exist there. The mixture of gas and air moves away from the manifold without combustion occurring until it reaches a point in the combustion zone where the introduction of further air from more openings in the baffles allows combustion to initiate.

The tertiary group 48 may include a tenth row 68 and an eleventh row 70. The tenth row 68 and the eleventh row 70 have apertures that are sized to cool the main flame and burn off any residual gas. Their size varies from very large to small. This was done to create a mixing effect which forces the flame into the combustion zone 35 and pushes the flame away from the end baffle 27.

Finally, the end baffles 27 are in this example imperforate. This limits the air from outside to impinge on the secondary flame 47. The end baffles 27 are also angled differently than the perforated baffle 26, thus creating a bigger protection zone where the combustion from the secondary combustion zone 51 can finalize.

The following gives an example of the sizes of the holes in the baffles 26. This is intended as an example only, and those skilled in the art will understand that modifications in the sizes of the holes will not necessarily affect the features and performance of the burner 16 as described herein. The first row 50 and the second row 52 have apertures 50*a* and 52*a* having a diameter of 0.055 inches. The third row 54 has apertures 54*a* having a diameter of 0.076 inches, except for the apertures 54*b* which have a diameter of 0.055 inches. The fourth row 56 has apertures 56*a* having a diameter of 0.086 inches. The fifth row 58 and the sixth row 60 have apertures having a diameter of 0.101 inches. The seventh row 62 has apertures that generally alternate between diameters of 0.096 inches and 0.154 inches. The eighth row 64 has apertures having a diameter of 0.154 inches. The ninth row 66 has apertures that generally alternate between diameters of 0.096 inches and 0.154 inches, except the center aperture 66*a* and the end apertures 66*b*, which have a diameter of 0.154 in. The tenth row 68 includes a set of apertures in which apertures 68*a* have a diameter of 0.140 inches, apertures 68*b* have a diameter of 0.343 inches, the end apertures 68*c* have a diameter of 0.218 in, and the center aperture 68*d* has a diameter of 0.312 inches. Finally, the eleventh row 70 has apertures in which the apertures on the end have a diameter of 0.218 inches, and the remaining apertures alternate between a diameter of 0.154 in and 0.343 in.

The apertures on the ends of the baffles 26 are generally disposed adjoining the front edge 26*a* and the rear edge 26*b*. However, the end apertures of the sixth, eighth, and tenth rows 60, 64, 68 are disposed slightly away from the edges 26*a*, 26*b* of the baffle 26 and towards the center, creating a snake-like or zig-zag pattern of apertures along the edges of the baffle 26. This creates an airflow that tends to move the flame toward the center of the burner unit 17 away from the end plates 31. On the last burner unit 17 of a burner assembly 16, an end plate 31 may be attached to contain the flame. By moving the flame towards the center of the combustion zone 35, quenching of the flame on the end plate 31 is prevented. Moreover, the end plate 31 does not overheat, and thus can be made from lighter materials such as sheet metal, instead of cast iron, which would otherwise be required.

A burner with a two-stage flame as herein described has many features which increase Btu output while helping to lower emissions. The amount of air and location of the apertures organizes the burner into a rich and lean combustion system. The flame established includes a primary flame 45 in the primary flame zone 49, and also includes a secondary flame 47 which may include individual flame jets along the baffle 26 in the secondary flame zone 51.

Due to the primary flame 45 in the primary flame zone 49, combustion is maintained throughout the entire combustion zone 35 at high fire, the capacity of the burner is much greater than prior art burners of a similar size. In one example, the burner unit 17 has a length B, and the baffle plates 26 have a length A. The ratio of B:A is at least 1:1, yet this burner can output up to 750,000 Btu's per lineal foot, and the burner can still maintain ANSI standards, and further a turndown ration of 30-1 can be achieved.

The baffles 26 described herein can be retrofitted to a currently existing manifold, thereby increasing the burner's capacity and lowering emissions without increasing the burner's footprint. Providing the same footprint allows existing end users to retrofit their old burners, thus saving on the time and expense of installing an entirely new burner if emissions at capacity is of importance.

The burner described herein also helps to lower emissions. A two-stage flame has a lower temperature than typical diffusion flames. The primary flame zone 49 is a very rich zone, and the secondary flame zone 51 is a lean zone. Flames burning in a rich zone, in the primary flame 45, have lower temperatures than typical diffusion flames, and thus reduce the formation of $NO_x$. In typical diffusion flames, the main path to $NO_x$ formation is from high temperature. Nitrogen from air reacts directly with the O radical forming nitrogen oxide. High energy is needed for breakup of nitrogen, however, and a lower temperature flame energy release is lower, thereby reducing the $NO_x$ formation.

The O radical is rapidly depleted by the reactions with hydrocarbons, and less O radicals are available to react with nitrogen. It changes the chemistry of combustion by introducing flue gases from the primary flame 45 into the secondary flame 47. The flame temperature in the secondary zone is reduced by the flue gases, and the formation of nitrogen dioxide is further reduced.

The secondary flame zone 51 represents the lean combustion zone. The apertures in this zone bring in air to finalize combustion. The flame in this zone is located on each aperture. By creating numerous flames, rather than one large flame burning at the end of the burner 17, the total flame size is essentially smaller. The secondary flame zone 51 is broken down into multiple small flame jets. The temperature of the individual flames is reduced, suppressing the formation of total NOx. Furthermore, the flame temperature is also reduced by the tertiary group 48. The tertiary group 48 has a tenth row 62 and an eleventh row 64 with apertures sized to cool the flame at the end of the combustion chamber 35 distal from the manifold.

Typically, the operation parameters of a direct-fired burner are governed by the emission of carbon monoxide and of nitrogen dioxide. By lowering the emission of nitrogen dioxide, the burner can achieve higher Btu output than in prior art burners. The formation of nitrogen dioxide is governed by the reactions of nitrogen monoxide and radicals such as $HO_2$ found in the low temperature regions of the flame such as near the outer edge of the flame. Nitrogen monoxide is the main precursor to the formation of nitrogen dioxide. Rapid quenching of the flame by the airflow around a burner increases the conversion of nitrogen monoxide to nitrogen dioxide. The influence of cold air penetrating the flame can be controlled and minimized by maintaining the flame within the protective baffle zone where only the air needed for combustion is introduced. By lowering the formation of nitrogen dioxide the burner's operation parameters can be increased.

Maintaining a primary flame 45 under all burning intensities ensures that a flame is maintained throughout the combustion chamber 35, and the flame does not move away towards the end of the baffles 26. Because the entire flame is contained within the baffles 26 and the imperforate end flanges 27, the flame is protected from the surrounding cold air, preventing the quenching of the flame. By protecting the flame from the surrounding air, the conversion of nitrogen monoxide to nitrogen dioxide is minimized. Due to the two-stage combustion within the baffles 26 the formation of nitrogen monoxide is controlled and minimized thus furthermore reducing the emission of nitrogen dioxide.

From the foregoing, one of ordinary skill in the art will appreciate that the present disclosure sets forth an apparatus and method for a two stage direct gas fired burner assembly which lowers the emissions of nitrogen dioxide and, by appropriately sizing the apparatus, lowers the CO emissions.

What is claimed is:

1. A gas-fired burner assembly, comprising:

a burner manifold including a pair of shoulders defining a trough therebetween;

a gas conduit disposed within the manifold and linked to the trough by a plurality of gas ports that transport gas from the conduit to the trough;

at least one air port provided in each shoulder, each air port linking the trough to ambient air to transport air into the trough, each air port being located substantially between each of the plurality of gas ports so as to form an air buffer between each gas port;

a pair of baffles, each baffle comprising a plurality of rows of apertures, fastened to the shoulders, and extending away from the trough in substantially a V-shape defining a combustion chamber therebetween;

the plurality of rows divided into at least a primary group of rows;

the primary group of rows comprising a first row of apertures and a second row of apertures disposed further from the trough than the first row of apertures;

the first row of apertures including a plurality of aperture pairs, each pair being aligned directly above a corresponding air port, thereby forming an air buffer between the gas ports; and the second row of apertures including a plurality of aperture triads, each triad having a center aperture aligned directly above a corresponding air port and apertures to either side of the central aperture aligned with one of the apertures of one of the aperture pairs, thereby forming an air buffer between the gas ports and creating a negative pressure zone above the air ports.

2. The assembly of claim 1, the primary group of rows further including a third row of apertures, the third row including substantially equidistantly spaced apertures, each aperture being directly above an air port.

3. The assembly of claim 2, wherein the apertures of the second row and the third row form a plurality of triangular-shaped aperture groupings.

4. The assembly of claim 1, wherein a primary flame is maintained proximate the primary group of rows.

5. The assembly of claim 4, further including a secondary group of rows of apertures, the secondary group including a fourth row of apertures, a fifth row of apertures, a sixth row of apertures, a seventh row of apertures, an eighth row of apertures, and a ninth row of apertures, each row disposed further from the trough than the preceding row.

6. The assembly of claim 5, wherein the fourth row includes a plurality of substantially equidistantly spaced apertures, each aperture being either directly above an air port or directly above a gas port.

7. The assembly of claim 6, wherein the apertures of the fourth row are larger than the apertures of the first, second and third rows.

8. The assembly of claim 6, wherein the apertures of the fourth, seventh, and ninth rows are directly above a gas port.

9. The assembly of claim 6, wherein the diameters of the apertures of the seventh and ninth rows alternate between two sizes, and the diameters of the apertures of each of the remaining rows are generally consistent within each row.

10. The assembly of claim 5, the plurality of rows further including a tertiary group of rows of apertures, the tertiary group including a tenth row of apertures and an eleventh row of apertures, each row disposed further from the trough than the preceding row.

11. The assembly of claim 10, wherein the baffles include an outwardly directed end flange, each end flange being imperforate.

12. The assembly of claim 11, wherein all combustion is contained within the combustion chamber between the manifold and the end flanges.

13. The assembly of claim 11, wherein the baffles further comprise a front edge and a rear edge, and the apertures provided in the baffles nearest the front and rear edges provided in a laterally offset orientation from the manifold to the end flanges.

14. The assembly of claim 13, further including first and second end plates spanning between the first and second baffles, the first and second end plates and first and second baffles being manufactured from sheet metal.

15. The assembly of claim 1, wherein the baffles extend from the manifold a distance A, and the manifold has a length B, the ratio of B to A being at least 1:1.

16. The assembly of claim 15, wherein the burner assembly has a Btu output of at least 750,000 Btu per lineal foot.

17. The assembly of claim 16, wherein the burner assembly has NO2 and CO emission levels which satisfy ANSI Standards Z83.4 and Z83.18.

* * * * *